United States Patent [19]

Swan

[11] 4,408,358

[45] Oct. 11, 1983

[54] COLD-WEATHER SPORTS GLOVE

[76] Inventor: Richard L. Swan, 1260 Monroe St., Reno, Nev. 89509

[21] Appl. No.: 408,695

[22] Filed: Aug. 16, 1982

[51] Int. Cl.[3] ..... A41D 19/00

[52] U.S. Cl. ..... 2/161 A

[58] Field of Search ..... 2/161 R, 161 A, 159, 2/164, 167, 168, 158, 16

[56] References Cited

U.S. PATENT DOCUMENTS

| | | | |
|---|---|---|---|
| 632,547 | 9/1899 | Barth . | |
| 1,215,163 | 2/1917 | Johnson . | |
| 3,128,472 | 4/1964 | Raney | 2/159 |
| 3,421,160 | 1/1969 | Domenico | 2/159 |
| 3,582,992 | 6/1971 | Gold | 2/16 |
| 4,131,952 | 1/1979 | Brenning, Jr. | 2/2 R |
| 4,164,043 | 8/1979 | Fujita | 2/161 A |
| 4,183,100 | 1/1980 | De Marco | 2/159 |

*Primary Examiner*—Doris L. Troutman

*Attorney, Agent, or Firm*—Roylance, Abrams, Berdo & Farley

[57] ABSTRACT

A cold-weather sports glove including at least one finger with an open distal end to expose the wearer's finger and a sealing assembly to limit cold air or water intrusion into the glove through the open end. The sealing assembly comprises a first annular circumferentially resilient member and a second annular circumferentially and radially resilient member located inside the finger adjacent the distal end. The distal end can also taper to form a part of the sealing assembly. The wrist portion of the glove can also have a sealing assembly thereon including first and second annular members.

21 Claims, 5 Drawing Figures

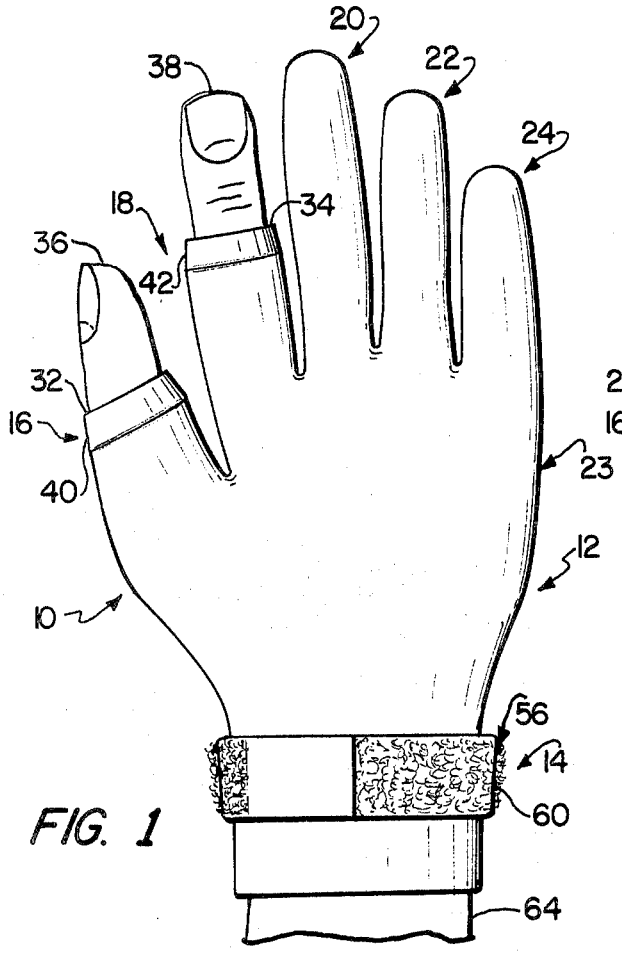
FIG. 1
FIG. 2
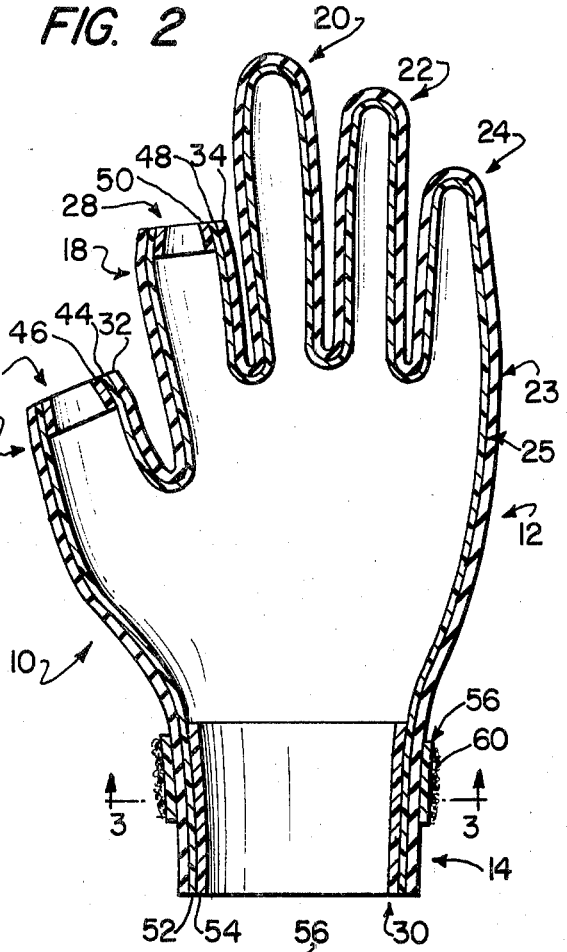
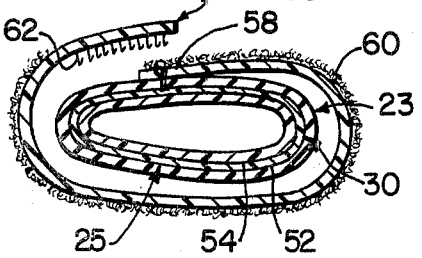
FIG. 3
FIG. 4
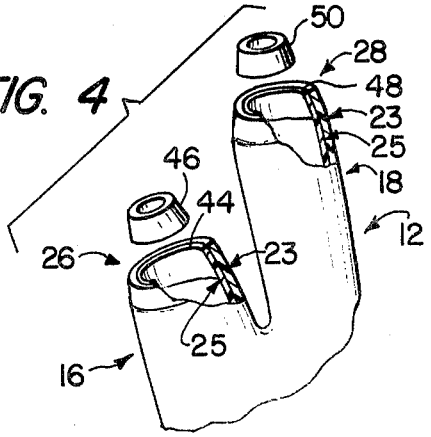
FIG. 5
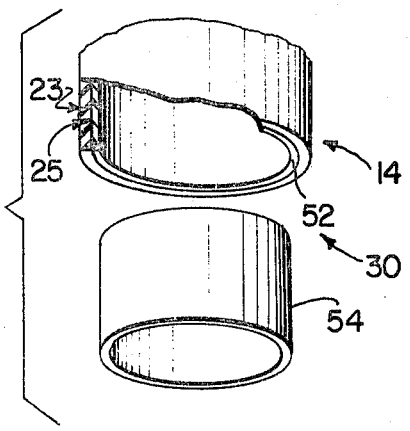

COLD-WEATHER SPORTS GLOVE

FIELD OF THE INVENTION

The invention relates to a glove which is particularly useful in cold weather during sporting activities. At least one of the glove's fingers is shortened and has an open distal end to expose the wearer's finger for use during the activity and a sealing assembly to limit cold air or water intrusion into the glove.

BACKGROUND OF THE INVENTION

With the increased interest in various sports, more and more of the traditional spring or summer sports are being undertaken during the colder fall and winter months. This calls for additional equipment, such as warm clothing, and especially gloves for protecting the hands while allowing participation in the sporting activity. A specific example is cold-weather fly fishing which requires the pulling of a wet line through the fingers when retrieving fly fishing line after a cast. In such a case, it is highly advantageous to use a pair of gloves which expose, and therefore provide sensitivity to, the thumb and index finger while keeping the remaining part of the hand covered and therefore warm. Similar requirements are found in hunting, kayaking, mountain climbing and other sports or commercial activities where certain fingers need to be used and therefore exposed.

Unfortunately, the prior art gloves while exposing some of the fingers do not provide an adequate sealing mechanism to prevent cold air or cold water intrusion into the glove through the area of the glove between the wearer's exposed finger and the cut-off finger of the glove. Examples of such prior art gloves are disclosed in the following U.S. Pat. Nos.: 632,547 to Barth; 1,215,163 to Johnson; 3,582,992 to Gold; 4,131,952 to Brenning, Jr.; 4,164,043 to Fujita; and 4,183,100 to De Marco.

SUMMARY OF THE INVENTION

Accordingly, a primary object of the invention is to provide a cold-weather glove that allows exposure of at least one of the wearer's fingers while sealing the glove around the exposed finger to limit cold air or water intrusion into the glove.

Another object of the invention is to provide such a glove wherein any desired finger can be reduced in length and provided with an open distal end and a sealing assembly to limit cold air or water intrusion into the glove through the shorted finger.

Another object of the invention is to provide such a glove where the open wrist portion similarly has a sealing assembly.

The foregoing objects are basically attained by providing such a cold-weather glove comprising a tubular hand portion; a tubular wrist portion extending from the hand portion; thumb, index finger, middle finger, ring finger and pinky tubular portions extending from the hand portion, at least one of the thumb, index finger, middle finger, ring finger and pinky tubular portions being open at the distal end thereof to expose the wearer's finger while the remaining tubular portions are closed at their distal ends; and sealing means, coupled to the at least one of the tubular portions adjacent the distal end thereof, for sealing the at least one of said tubular portions to the wearer's finger to limit cold air or water intrusion into the glove at the open distal end thereof.

Advantageously, the sealing assembly comprises a first annular circumferentially resilient member and a second annular circumferentially and radially resilient member located inside the finger adjacent the distal end thereof. This first annular member can be made of nylon fabric while the second annular member can be made of light density polyurethane foam.

In addition, a sealing assembly can be located inside the wrist portion of the glove comprising a first annular circumferentially resilient member and a second annular circumferentially and radially resilient member.

Other objects, advantages and salient features of the invention will become apparent from the following detailed description which, taken in conjunction with the annexed drawings, discloses a preferred embodiment of the invention.

DRAWINGS

Referring now to the drawings which form a part of this original disclosure:

FIG. 1 is a top plan view of a sports glove in accordance with the present invention with the wearer's hand received therein and showing the thumb and index finger exposed;

FIG. 2 is a top plan longitudinal sectional view of the glove shown in FIG. 1 without the wearer's hand located therein;

FIG. 3 is a side elevational view in transverse section taken along line 3—3 in FIG. 2 showing the wrist portion of the glove;

FIG. 4 is a fragmentary, top plan exploded view of the thumb and index finger tubular portions of the glove in FIG. 1 with the first and second annular sealing members being particularly shown; and FIG. 5 is a fragmentary, top plan exploded view of the wrist portion of the glove shown in FIG. 1 with the first and second annular sealing members being particularly shown.

DETAILED DESCRIPTION OF THE INVENTION

As seen in FIGS. 1 and 2, the cold-weather sports glove 10 in accordance with the invention comprises a tubular hand portion 12, a tubular wrist portion 14, a tubular thumb portion 16, a tubular index finger portion 18, a tubular middle finger portion 20, a tubular ring finger portion 22 and a pinky portion 24 constructed by using conventional glove-making methods. These portions of the glove are preferably formed of an outer rubber layer 23, e.g., a layer of closed cell neoprene foam of a three millimeter thickness, and an inner nylon fabric layer 25 which are adhered together such as by rubber cement. These layers are resilient and stretchable. As seen best in FIG. 2, a first sealing assembly 26 is located inside the thumb portion 16 and a second sealing assembly 28 is located inside the index finger portion for sealing the wearer's thumb and index finger to the tubular portions for limiting cold air or water intrusion into the glove, these sealing assemblies being located inside the tubular portions adjacent the open distal ends, these tubular portions being reduced in length. In addition, a third sealing assembly 30 is located inside the wrist portion 14 to limit cold air or water intrusion into the glove between the wearer's forearm and the wrist portion of the glove.

As seen in FIGS. 1 and 2, the tubular hand portion 12 is open ended and has the open ended tubular wrist portion 14 extending therefrom at the bottom of the glove. At the other end of the tubular hand portion 12 the tubular thumb, index finger, middle finger, ring finger and pinky portions extend from the hand portion with the distal ends of the middle finger, ring finger and pinky portions being closed.

The distal ends 32 and 34 of the thumb portion 16 and index finger portion 18 are open, with these portions being cut off from their usual length and shortened as seen clearly in FIGS. 1 and 2. Thus, as seen in FIG. 1, the wearer's thumb 36 is exposed and extends from the thumb portion 16 so that the distal end 32 is between the nail and second knuckle of the thumb. Similarly, as seen in FIG. 1, the wearer's index finger 38 is exposed and extends from the distal end 34 of the index finger portion 18 so that the distal end 34 is located between the second and third knuckle on the index finger. Advantageously as part of the sealing assembly, the ends of the thumb portion 16 and index finger portion 18 are tapered at 40 and 42, respectively, to provide a radially inwardly tapering frustoconical end to each of the cut-off thumb and index finger portions. Advantageously, the material forming the thumb and index finger portions can taper about one to four millimeters in the last centimeter thereof. This can be accomplished by providing a short longitudinal cut or slot in the material of the inner and outer layers 23 and 25 at the distal end and restitching and gluing the material adjacent the cut or slot.

As seen best in FIGS. 2 and 4, the first sealing assembly 26 associated with the thumb portion 16 comprises a first annular sealing member 44 and a second annular sealing member 46. The second sealing member 46 is advantageously formed of low density polyurethane foam with a one to four millimeter thickness and a 0.75–2.0 centimeter width, this sealing member being formed in an annular or ring configuration by suitable stitching and gluing of the ends. The sealing member is circumferentially and radially resilient. The first sealing member 44 is part of the elastic nylon fabric layer 25 located in the thumb portion 16. This sealing member is circumferentially resilient and is as seen in FIG. 2 located concentrically inside and rigidly coupled, such as by gluing, to the thumb portion 16 and extends up to the distal end 32. In addition, the first sealing member 44 is rigidly coupled, such as by gluing, to the outer surface of the second annular sealing member 46.

The second sealing assembly 28 is comprised of a first annular sealing member 48 and a second annular sealing member 50 which correspond in size, material and placement as members 44 and 46 except that they are located inside the index finger portion 18 as seen in FIG. 2.

As seen in FIGS. 2, 3 and 5, the third sealing assembly 30 is formed from a first annular sealing member 52 and a second annular sealing member 54, these members being located inside the wrist portion adjacent the open distal end thereof. The second annular sealing member 54 is advantageously formed of low density polyurethane foam, is circumferentially and radially resilient, is about one to four millimeters thick and about three to four and a half centimeters wide. The first annular sealing member 52 is advantageously formed as part of the elastic nylon fabric layer 25 in the glove and is circumferentially resilient. This first sealing member is located in and rigidly coupled to the inside of the wrist portion 14 by a suitable glue, such as rubber cement, and in turn the second sealing member 54 is glued to the inside of the first sealing member 52.

As seen in FIGS. 1–3, a wrist strap 56, preferably formed of non-stretchable nylon, is rigidly coupled at one end 58 such as by stitching to the wrist portion 14 of the glove and has Velcro eye fasteners 60 on the outside surface thereof and a series of Velcro hook fasteners 62 on the inside thereof near the free end. Accordingly, the wrist strap 56 can be tensioned around the wearer's forearm 64 as seen in FIG. 1 adjacent the wrist of the wearer to aid in sealing the forearm and wrist portion, this strap overlapping the second sealing member 54 as seen in FIG. 2 to enhance the seal.

As is evident from FIGS. 1 and 2, cold air and water intrusion into the glove 10 is limited by means of the force fit of the wearer's thumb 36 and index finger 38 with the sealing assemblies 26 and 28. Similarly, cold air and water intrusion into the glove through the wrist portion 14 is limited by the force fit of the wearer's forearm 64 and the wrist portion via the third sealing assembly 30.

While the first and second sealing assemblies 26 and 28 have been shown on the thumb and index finger portions of the glove, it is intended that any selected finger portion can have such a sealing assembly. In addition, the glove can be used for commercial or other activities, such as placing chains on a motor vehicle during cold weather or commercial fishing.

As used herein, "circumferentially resilient" means that the annular member formed of such material will increase in circumference and diameter when a finger having a larger diameter is placed therein but will bias inwardly against the finger so placed therein. The phrase "radially resilient" means that the annular member formed of such material will decrease in thickness when a finger having a larger diameter is placed therein but will bias inwardly against the finger so placed therein by means of the inherent springiness or resiliency of the material itself.

While one advantageous embodiment has been chosen to illustrate the invention, it will be understood by those skilled in the art that various changes and modifications can be made therein without departing from the scope of the invention as defined in the appended claims. Thus, sealing assemblies 26 and 28 can comprise the first and second annular members as well as the tapering portion, these annular members without the tapering portion or the tapering portion substantially by itself. In the last case a non-fabric ring or band of rubber or rubber-coated fabric is coupled to the nylon fabric 25 inside the tapering portion to seal against the wearer's finger, which would provide a better seal against the wearer's skin than the nylon fabric.

What is claimed is:

1. A cold weather glove comprising:

a tubular hand portion;

a tubular wrist portion extending from said hand portion;

thumb, index finger, middle finger, ring finger and pinky tubular portions extending from said hand portion, said middle finger, ring finger and pinky tubular portions being closed at their distal ends, said thumb and index finger tubular portions being shortened and being open at their distal ends to expose the wearer's thumb and index fingers; and first and second sealing means, coupled to each of said thumb and index finger portions adjacent said distal ends, for sealing said thumb and index finger portions to the wearer's thumb and index finger to limit cold air or water intrusion into the glove at said open distal ends of said thumb and index finger tubular portions.

2. A glove according to claim 1, wherein said tubular thumb portion has said open distal end located between the nail and second knuckle on the wearer's thumb.

3. A glove according to claim 1, wherein said tubular index finger portion has said open distal end located between the second and third knuckles on the wearer's index finger.

4. A glove according to claim 1, wherein said first and second sealing means each comprises an annular member secured inside each of said thumb and index finger tubular portions.

5. A glove according to claim 4, wherein said annular members are formed of resilient material.

6. A glove according to claim 5, wherein said resilient material forming each of said second sealing means is a foam.

7. A glove according to claim 1, wherein said hand portion, wrist portion and thumb, index finger, middle finger, ring finger and pinky portions are formed of rubber.

8. A glove according to claim 1, wherein said tubular thumb and index finger portions taper radially inwardly at the open distal ends.

9. A glove according to claim 8, wherein said first and second sealing means each comprises an annular member secured inside each of said thumb and index finger tubular portions.

10. A glove according to claim 9, wherein said annular members are formed of resilient material.

11. A glove according to claim 1, wherein said first sealing means each comprises a circumferentially resilient first annular member coupled to each of said thumb and index finger portions, and said second sealing ring means each comprises a radially and circumferentially resilient second annular member coupled to said first annular member.

12. A glove according to claim 11, wherein said first annular members are coupled inside each of said thumb and index finger tubular portions.

13. A glove according to claim 11, wherein said first annular members are formed of nylon fabric, and said second annular members are formed of a foam.

14. A glove according to claim 1, and further comprising third sealing means, coupled to said wrist portion adjacent the distal end thereof, for sealing said wrist portion to the wearer's wrist to limit cold air and water intrusion into the glove at said wrist portion distal end.

15. A glove according to claim 14, wherein said third sealing means comprises an annular radially and circumferentially resilient member coupled inside and to said wrist portion.

16. A glove according to claim 15, wherein said third sealing means further comprises a circumferentially resilient annular member interposed between said annular radially and circumferentially resilient member and said wrist portion and coupled to both.

17. A cold-weather glove comprising:

a tubular hand portion;

a tubular wrist portion extending from said hand portion;

thumb, index finger, middle finger, ring finger and pinky tubular portions extending from said hand portion, at least one of said thumb, index finger, middle finger, ring finger and pinky tubular portions being open at the distal end thereof to expose the wearer's finger while the remaining tubular portions are closed at their distal ends; and first and second sealing means, coupled to said at least one of said tubular portions adjacent the distal end thereof, for sealing said at least one of said tubular portions to the wearer's finger to limit cold air or water intrusion into the glove at the open distal end thereof.

18. A glove according to claim 17, wherein said first and second sealing means each comprises an annular member formed of resilient material and located inside said at least one of said tubular portions.

19. A glove according to claim 18, wherein said resilient material forming said second sealing means is a foam.

20. A glove according to claim 17, wherein said at least one of said tubular portions comprises a radially inwardly directed tapering portion at the open distal end thereof.

21. A cold-weather glove comprising:

a tubular hand portion;

a tubular wrist portion extending from said hand portion;

thumb, index finger, middle finger, ring finger and pinky tubular portions extending from said hand portion, at least one of said thumb, index finger, middle finger, ring finger and pinky tubular portions being open at the distal end thereof to expose the wearer's finger while the remaining tubular portions are closed at their distal ends; and sealing means, coupled to said at least one of said tubular portions adjacent the distal end thereof, for sealing said at least one of said tubular portions to the wearer's finger to limit cold air or water intrusion into the glove at the open distal end thereof, said sealing means comprising a radially inwardly directed tapering portion at the open distal end of said at least one of said tubular portions.

* * * * *